United States Patent [19]

Hancock

[11] Patent Number: 4,780,917

[45] Date of Patent: Nov. 1, 1988

[54] SPA CONSTRUCTION WITH INTEGRATED SPA SIDE AND INSIDE CONTROL SYSTEM

[76] Inventor: James W. Hancock, R.D. #2, Cochranville, Pa. 19330

[21] Appl. No.: 623

[22] Filed: Jan. 5, 1987

[51] Int. Cl.[4] ..... A61H 33/02

[52] U.S. Cl. ..... 4/544; 4/542

[58] Field of Search ..... 4/492, 493, 496, 507, 4/508, 509, 541-544

[56] References Cited

U.S. PATENT DOCUMENTS

| | | | |
|---|---|---|---|
| 3,778,804 | 12/1973 | Adair | 4/496 |
| 4,169,293 | 10/1979 | Weaver | 4/544 |
| 4,233,694 | 11/1980 | Janosko et al. | 4/493 |
| 4,330,412 | 5/1982 | Frederick | 4/492 |
| 4,368,549 | 1/1983 | Ramey | 4/493 |
| 4,404,697 | 9/1983 | Hatcher | 4/492 |
| 4,663,613 | 5/1987 | Raleigh et al. | 4/544 |

FOREIGN PATENT DOCUMENTS

| | | | |
|---|---|---|---|
| 3530711 | 8/1985 | Fed. Rep. of Germany | 4/492 |

*Primary Examiner*—Henry J. Recla
*Assistant Examiner*—Linda J. Sholl
*Attorney, Agent, or Firm*—Sughrue, Mion, Zinn, Macpeak, and Seas

[57] ABSTRACT

An exteriorly installed therapeutic spa has a water circulation loop, including an electric heater for heating the water, an electric motor-driven pump for circulating the water at low and high speeds and electric motor-operated blower for injecting air into the water. Control is effected by an in-house control panel within a residence, a spa side control unit mounted on the spa shell for access by the spa occupant and a main control panel at an equipment area. The control system incorporates a low voltage transformer and rectifier to provide low voltage DC. The spa side control unit utilizes a plurality of low voltage hermetically sealed switches under manual knob control, acting in parallel with in-house control panel low voltage switches. Low voltage relays responsive to low voltage switch operation control operation of the equipment within the equipment area under thermostat control with high voltage override manual switches at the main control panel. Vacation switches within the house and at the main control panel selectively disable at least the in-house switches and insures low flow velocity circulation of the water and heating of the same responsive to freeze thermostat switch closure.

22 Claims, 5 Drawing Sheets

SPA CONSTRUCTION WITH INTEGRATED SPA SIDE AND INSIDE CONTROL SYSTEM

This invention relates to a whirlpool, therapeutic spa or hot tube construction and more particularly to an integrated control system providing complete spa side control of temperature, pump operation, blower and spa light.

BACKGROUND OF THE INVENTION

Spas have been constructed of unitary, fiber glass construction with associated heater, filters, motors and pumps to one side of the unit and connected by suitable piping. In the past, the controls have been provided interiorly of the residence or other building structure with the spa or pool located outside of that structure. Attempts have been made to incorporate some of the controls within the spa itself and accessible to the user when the user is within the spa. Some spas have a control panel exterior of the building but remote from the spa itself.

Spas or hot tubs, similar to outdoor swimming pools, are subject to unauthorized use by intruders on the property, particularly when the owners or users are absent from the residence. Where the controls are internally of the residence and the residence locked, this frustrates the use of the spas by intruders. However, this results in the necessity for setting the control internally which frustrates the user when the user is within the spa. Control systems for such spas are subject to the possibility of electrocution of the user within the spa where such control systems include a control unit incorporated within the spa itself or positioned adjacent to the spa subject to high voltage and within reach of the user while partially immersed.

While attempts have been made to isolate the control unit at the spa from the high voltage necessary for operating the heater, motors, pumps and blowers, such isolation has not always been effectively achieved or maintained.

Where the spa is subject to water freeze during the winter, water may be circulated by the pump through the heater and the heater set at low temperature to heat the water sufficiently to prevent such freezing. In the past, known control systems have failed to take care of the problem for insuring that the pump and the heater are operated under "freeze" conditions in the absence of owner initiation of such operation.

With respect to the piping leading to and from the spa and interlinked with the heater, filter units and pumps, such piping has been complicated with restriction of access to the thermostat for controlling the operation of the heater and pump in the circulating water loop. Further, such thermostat and its housing, in the past has interfered with proper flow of the circulated water.

Attempts have been made to overcome the problems described above, to simplify the spa structure and to provide a multiaccessible control system. U.S. patents illustrative of prior art spa constructions and specific controls, both spa side and remote from the spa itself are as follows: U.S. Pat. Nos. 3,781,925, 4,393,527, 4,339,833, 4,385,724, 4,404,697, 4,409,694, and 4,564,962.

It is, therefore, an object of the present invention to provide an improved spa construction which may be readily installed exterior to or within a residence include a waterproof, low voltage, spa side control unit integrated to the spa shell for control of the circulating water temperature (heater), pump operation, blower and spa light, wherein operation of the spa is from the interior of the spa itself in which said spa side control unit is fully waterproof, is of simplified construction and is of relatively low cost.

It is a further object of the invention to provide a spa construction of this type, wherein the control system includes a vacation switch which prevents normal operation and control of the spa by the spa side control unit but which includes a freeze override for running the pump and heater to maintain the water temperature slightly above freezing, and wherein the control system utilizes a key operated switch within the control panel at the equipment area for maximum security and wherein the spa construction includes the thermostat well assembly integrated to the circulating water suction pipe, having no adverse effect on the flow rate of the water circulated through the heater at the equipment area and permitting ready access to the thermostat for removal and replacement.

Additional objects and features of the invention will appear from the following description in which the preferred embodiments are set forth in detail in conjunction with the accompanying drawings.

DESCRIPTION OF THE PREFERRED EMBODIMENT

Figure 1:
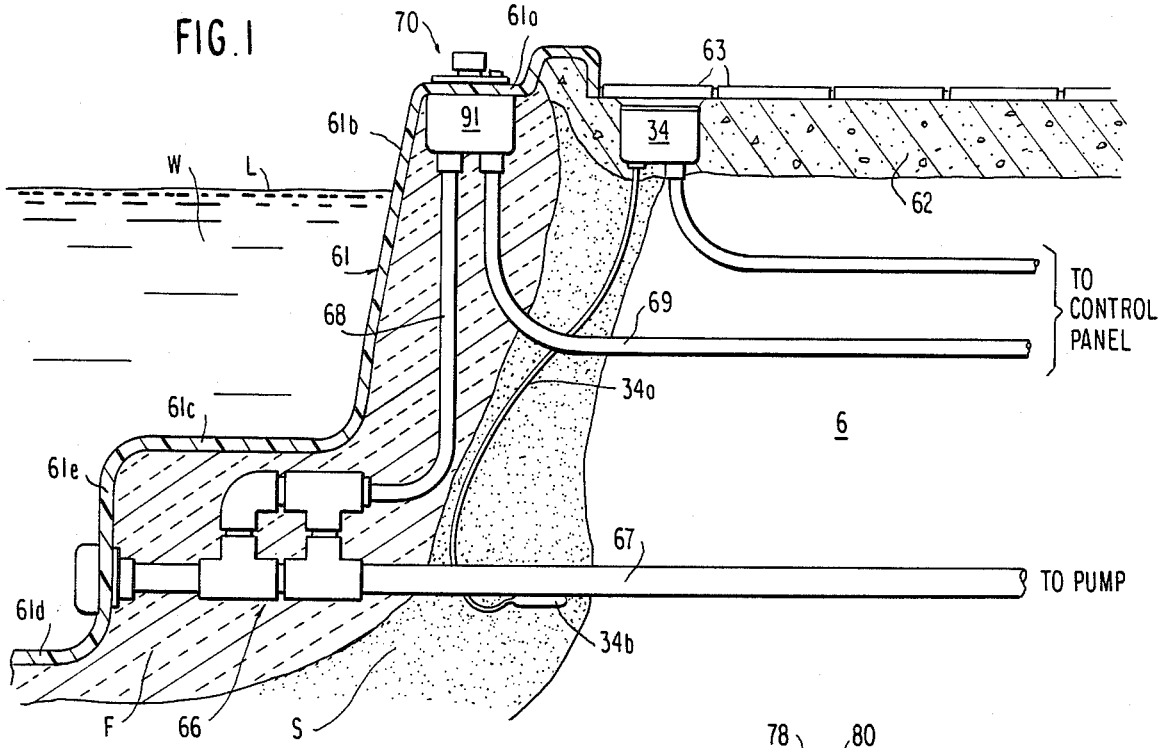
FIG. 1 is a vertical sectional view of the improved spa showing one side of the spa shell, forming a preferred embodiment of the invention and illustrating the makeup and location of the spa side control unit, the improved, simplified thermostat well and one of the freeze thermostats forming principal components of the spa construction.
Figure 2:
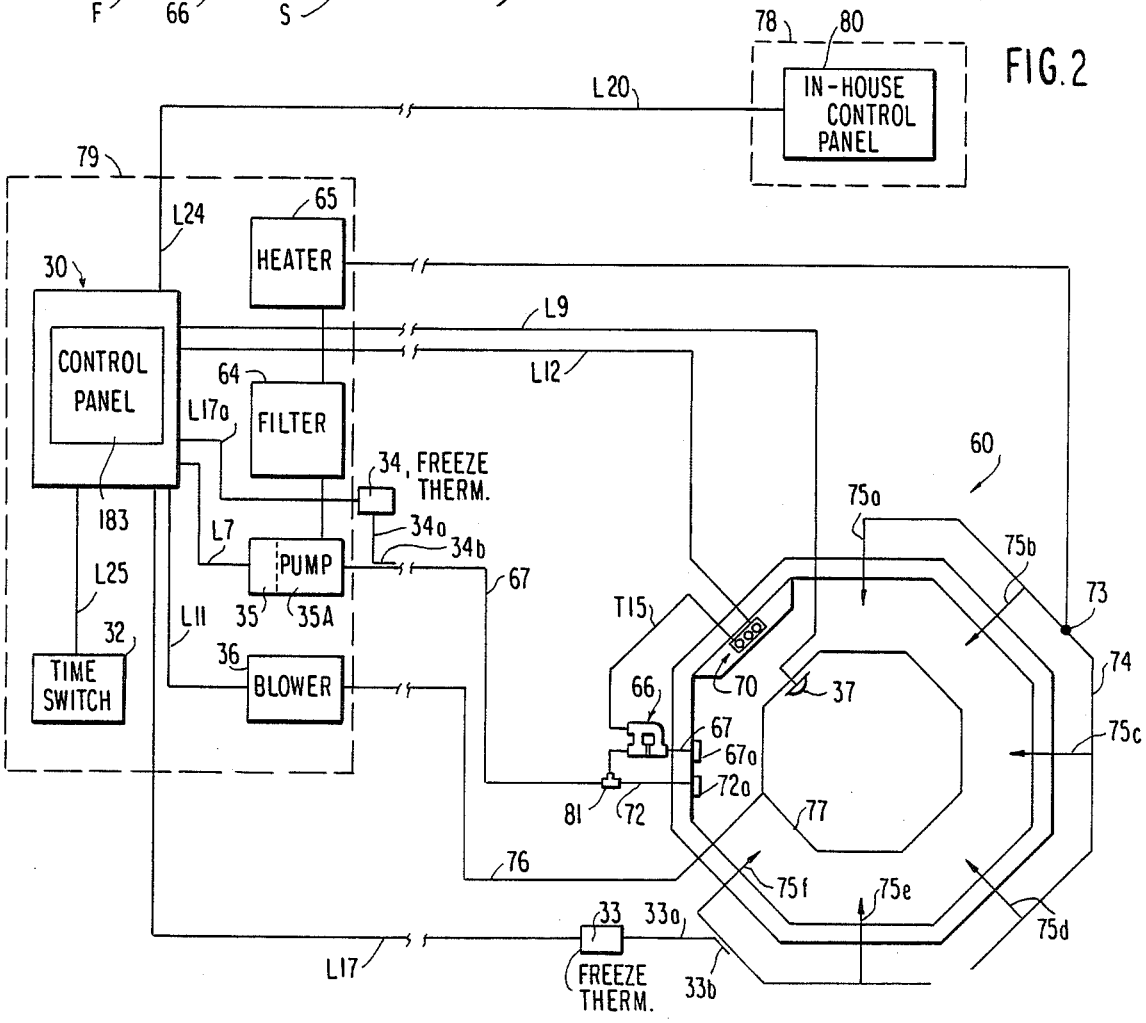
FIG. 2 is a schematic, partial plan view of the spa construction illustrated in FIG. 1 and of the principal components making up the same.

Reference to FIGS. 1 and 2 show both, in physical terms and schematically, the basic makeup of a preferred embodiment of a spa indicated generally at 60 forming a preferred embodiment of the invention. In that respect, the spa is formed principally of a spa shell indicated generally at 61 within which water W is provided to a predetermined level L. The spa shell 61 is formed of molded plastic as an upwardly open tub including integrally; a generally horizontal rim 61*a*, a near vertical back rest 61*b*, a seat 61*c*, and a central recessed, horizontal bottom wall 61*d* which merges with the seat 61*c* via vertical wall portion 61*e*. The spa shell 61 is set normally within the earth or ground G which may be backfilled by sand S. The tub shell 61 may be backed by foam insulation F. Further, a poured concrete slab 62 may be integrated to the rim 61*a* of the spa shell and suitable surface tile 63 carried on the upper surface of the concrete slab 62 to form an apron about the perimeter of spa shell 61. The water W, as may be appreciated, requires heating and is maintained at a relatively high temperature slightly above or below 100° F. during use. The water is circulated through a filter 64, FIG. 2, and heater 65 by a suitable electric motor driven pump as at 35A, FIG. 2. A blower 36 is provided which is also electrically motor driven for supplying compressed air to an air channel 77, FIG. 2, which air is injected below the water level L. The circulated water is filtered through filter 64.

Included with the several major components of the system of FIG. 2 and illustrated in FIG. 1 are: a thermostat well assembly indicated generally at 66, the spa side control unit indicated generally at 70 and one, 34 of two freeze thermostats. With respect to FIG. 2, which shows these elements, the control system is characterized by a suitable in-house control panel 80 within a building or residence 78. In the various figures throughout the application, the electrical lines which are numbered, are also given the letter designations "L" to distinguish them from the hydraulic lines or pipes which are solely given numerical designations.

The control system interconnects three geographically separate areas; the whirlpool spa indicated generally at 60, FIG. 2, the equipment area indicated by dotted lines at 79 which is normally externally of the building and to one side of the whirlpool spa 60, and the house or residence 78, also shown in dotted lines in the schematic view of FIG. 2.

FIG. 2 is a simplified, combined hydraulic and electrical diagram of the spa and its control system. However, it correlates to the more detailed electrical schematic diagrams of FIGS. 9 and 10 forming preferred embodiments of the invention. Various electrical components are incorporated within the in-house control panel 80, the control panel 30 within the equipment area 79 and the spa side control unit indicated generally at 70. The spa side control unit is mounted on lip 61*a* of the molded fiber glass spa shell 61. At tubular plastic suction pipe as at 67, FIGS. 1 and 2, opening to shell 61 via suction inlet 67*a*, provides a circulation loop for the water from the interior of the spa shell 61 to the pump 35A, from the pump 35A through filter 64 to the heater 65 and back to the spa 60 where the pipe 67 connects at point 73 to a hot water distribution manifold 74. Manifold includes various injectors 75*a* to 75*f* which open to the spa shell interior, below the water level L. A bypass pipe 72 leads from the interior of the spa shell 61 via inlet 72*a* and connects to suction pipe 67 via a tee fitting or the like 81, bypassing the thermostat well 66. The bypass pipe 72 may be optionally employed in the system. Approximately one-half the water to the pump would be drawn through suction pipe 67.

The balance of the lines shown in FIG. 2 are electrical and are all given alpha-numeric designations with the letter L preceding the number of each line. In that respect, line L 20 connects the in-house control panel 80 to the equipment area main control panel 30. Line L 12 connects control panel 30 to the spa side control unit 70. Time switch 32 is connected to control panel 30 via line L 25. Heater 65 is connected to the control panel 30 via line L 24, the electric pump motor 35 of pump 35*a* is connected via line L 7 to the control panel 30 and the blower 36 is connected to the control panel 30 via line L 11. Lines L 17 and L 17*a* connect freeze thermostats 34 and 33, respectively, to the control panel 30. Freeze thermostat 34 is located near the equipment to assure there will be no damage to the equipment from freezing. A thermal bulb 34*b* leads to freeze thermostat 34 via tube 34*a* while in turn, tube 33*a* leads from freeze thermostat 33 to the temperature-sensitive sensing bulb 33*b*. Bulb 34*b* is mounted on the exterior of suction pipe 67 leading from the spa shell 61 to the pump 35*a* to sense the temperature of the water being circulated upstream of the heater 65. For freeze thermostat 33, its temperature sensing bulb 33*b* is mounted adjacent to the hot water manifold 74 to sense a near freeze condition for the water returned through the loop and just prior to injection into the spa shell 61, or where the plumbing may be the coldest.

Referring to FIGS. 2 through 7, inclusive, a principal aspect of the present invention resides in the structural makeup and incorporation of the spa side control unit 70 into the spa shell 61 for ready control of the whirlpool spa or hot tube 60 without leaving the spa. Spa side control unit 70 is rendered waterproof to eliminate water or humidity infiltration into the area occupied by the low voltage switches inside the unit 70. Preferably the spa side control unit 70 includes a remote bulb thermostat switch and microswitches. The thermostat switch 2*a* of the spa side control unit 70 controls various relays or contactors designed to operate the spa or hot tub equipment.

Figure 3:
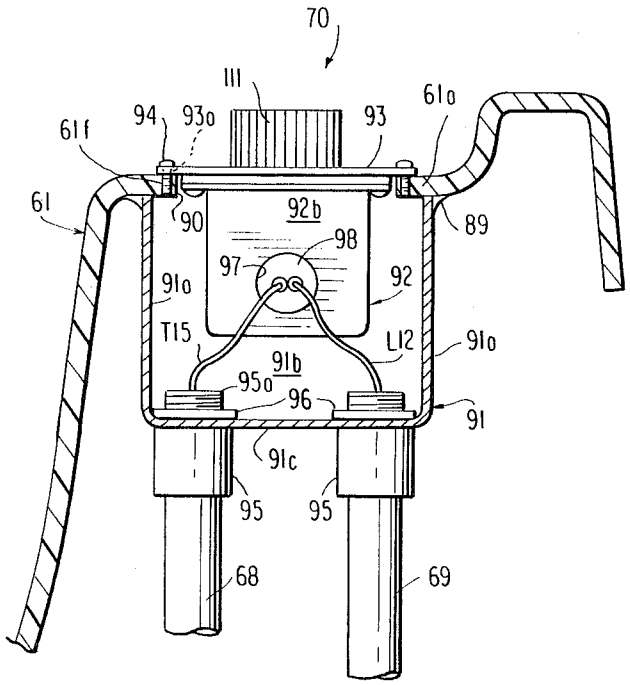
FIG. 3 is an enlarged sectional view of the portion of the spa shell housing the spa side control unit as shown in FIG. 1.

Preferably, a rectangular hole or opening 90 is formed with the rim 61*a* of the spa shell 61. Where the spa 60 is installed in the ground G as per FIG. 1 and backfilled with sand S, a sand protector shield is required. The sand protector shield comprises a rectangular, upwardly open, sand protector shield box 91 having laterally opposed sidewalls 91*a*, longitudinally opposed end walls 91*b* and a bottom wall 91*c*. Further, the box dimensions are larger than that of the rectangular opening 90 so that the upper end of the sand protector shield box 91 lies outside of opening 90 and surrounds the same. The box 91 is epoxyed in at 89 about the upper edges of its end walls and sidewalls to the bottom surface of rim 61*a* in a water tight manner. Positioned internally of the sand protector shield box 91, FIG. 3, is spa side control unit housing, indicated generally at 92, which may be formed of molded plastic, metal or the like. Housing 92 comprises a flanged, upwardly open rectangular box formed of laterally opposed sidewalls 92*a*, longitudinally opposed end walls 92*b* and an integral bottom wall 92*c*. The housing 92 includes an integral flange 92*d* extending around the upper edge of the box, through which are drilled a series of mounting holes 100.

Control panel face 93 is a one-piece item with a mounting rim, 93*a* to mount the unit to spa shell and mounting area 93 for mounting flange 92*d*. A cover or control panel face 93 is mounted to flange 92*d* of the control unit housing 92 by means of screws 99 which extend upwardly through holes 100 within flange 92*d* of housing 92 to mount the cover 93 about the open top of housing 92. Cover 93 includes a lower portion 93*b* which is sized to the flange 92*d* of housing 92, and, a slightly larger rectangular panel face rim 93*a* which facilitates the mounting of the control unit housing 92 to spa shell rim 61*a*. In that respect, holes (not shown) are drilled through the laterally projecting panel face or cover 93 and tapped holes 61*f* are provided within rim 61*a* about the rectangular opening 90 to receive mounting screws 94.

A pair of circular holes are provided within the bottom wall 91*c* of box 91 within which are mounted respective cylindrical pipe couplings 94 having threaded upper ends 95*a*. Lock nuts 96 are threaded to the threaded ends 95*a* of the couplings 95 functioning to couple the ends of respective plastic pipes 68, 69 to sand protector shield box 91. Pipe 68, as shown in FIG. 1, leads from the thermostat well 66 to the spa side control unit 70 and carries line L 15 from the bulb or sensor for thermostat 2 located within thermostat well 66 to spa side control unit housing 92. Conduit or pipe 69 extends from the spa side control unit 70 to the main control panel 30 within the equipment are with line L 12 interconnecting the spa side control unit 70 and the main control panel 30. Lines L 12, L 15, penetrate the interior of the spa side control unit housing 92 via a sealed coupling or connector 98 mounted within a circular hole 97 provided within one of the end walls 92*b* of housing 92. The spa side control unit 70, illustrated in FIGS. 3 through 7, inclusive, as a preferred embodiment of the invention consists of three control knob operated assemblies, a remote bulb thermostat, indicated generally at 2, a pump control—low speed, high speed temperature/priority unit 3, indicated generally at 3, and a blower/light unit 4. The operating control elements of the three assemblies are located within the interior 101 of the housing 92. Spaced, longitudinally aligned holes 102, 103 and 104 are drilled through the cover 93. A mounting block 105 is fixed to the bottom of the cover 93 and by way of brackets 106. Block 105 mounts thermostat switch 2*a*. Projecting vertically upwards towards hole 102 from the thermostat switch 2*a* is a switch operating shaft 107. The shaft 107 is provided with a flat at 107*a* which mates with a flattened surface 108*a* of an axial bore 108*b* within a shaft extension 108 whose upper end 108*c* projects through the hole 102. End 108*a* has fixedly mounted thereto a first control knob 109. Similar control knobs 110 and 111 are provided for control units 3 and 4, the knobs being longitudinally in line, FIG. 4. A cylindrical block or hub 112 is fixedly mounted to the cover panel face 93 and has a bore 113 which is sized slightly larger than diameter of the reduced diameter portion 108*c* of shaft extension 108. Hub 112, therefore, acts as a bearing for guiding shaft extension 108*c* as it rotates about its axis in response to rotation of knob 109. The knob 109 is connected to the shaft extension 108 via a set screw 114. The control knob 109 is provided with a cylindrical recess 115 within its lower face 109*a* which is of a diameter slightly larger than that of block 112 so that the control knob fits concentrically over the hub 112. An annular groove 116 is provided within the periphery of hub 112 and an O-ring 117 sized to the diameter of the groove is provided therein with the O-ring projecting outwardly from the periphery of block 112 and being in sealed abutment with the inner periphery of knob recess 115. As a result, the O-ring seal prevents the ingress of water accumulating on the surface of the panel face 93*a* of cover 93 into the housing interior 101. Preferably, a second set screw 118 is fitted behind the first set screw 14 with a suitable drop of silicone sealant between the set screws to stop the moisture from entering in and around the first set screw to the shaft extension 108. The end 114*a* of the set screw abuts a recess 108*d* within the reduced diameter portion 108*c* of the shaft extension 108 to fix the control knob 109 at a given angular position with respect to the shaft extension 108 fixed to shaft 107.

Control knob 110 is associated with and is affixed to a rotary shaft 120 which is similarly mounted via a cylindrical hub 121 fixed to the panel face 93*a* and received within a cylindrical well or recess 122 of knob 110 in the same manner as thermostat 2. Similarly, the hub 121 includes an annular groove 123 bearing an O-ring 124 whose outer periphery abuts the side wall of the recess 122 within knob 110 to form an effective water tight seal between the rotating control knob 110 and the shaft 120 affixed thereto. The shaft 120 projects through a hole or bore 125 within hub 121 and the lower end of the shaft 120 carries three axially spaced cams or flats for controlling respective microswitches A, B, C, forming a first microswitch array 126. The switches A, B, C may be one-half ampere miniature microswitches or 10 amp microswitches, mounted by way of mounting screws or bolts 127 which pass through their respective casings, having their upper threaded ends embedded within cover 93. With the microswitches positioned on the back of the cover 93, respective plungers 127A, 127B, 127C are spring biased against the periphery of the shaft 120 at respective longitudinally spaced positions along that shaft. The number of microswitches to be actuated by the control shaft 120 for unit 3 and by control shaft 130 for knob 111 of unit 4 are determined by the number of pieces of equipment or relays that are to be operated by a given control knob and secondly by the number of positions to which the knob may be rotated.

Figure 4:
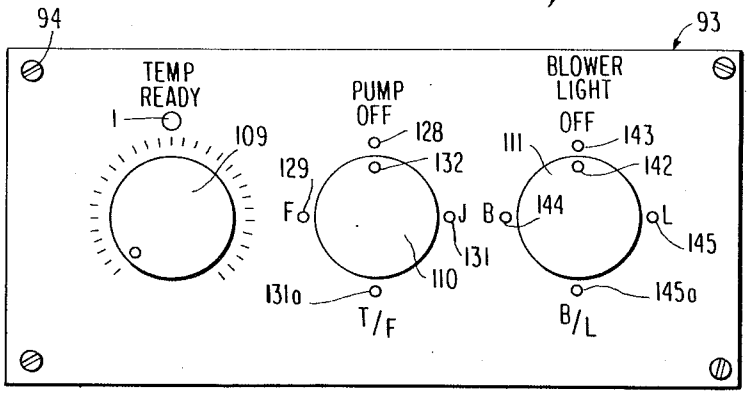
FIG. 4 is a top plan view of the spa side control unit mounted to the spa shell as shown in FIGS. 1 and 3.

In FIG. 4, control knob 110 is more correctly referred to as the pump mode control knob—the positions being—OFF, low speed for filtration, high speed for jets, and low speed filtration controlled by the thermostat 2.

As may be seen by reference to FIG. 4, for the temperature/priority unit control knob 110, there are three indicated positions of adjustment for knob 110. The pump OFF position is indicated by a circular indicator dot at 128. Ninety degrees to one side thereof, upon knob rotation counterclockwise, is a second indicator dot 129 with an appropriate indicator letter F for filter, adjacent thereto. A corresponding flat on the control shaft 120 permits the plunger 127B to extend to switch the contacts of microswitch B, which in turn actuates the appropriate relay and the corresponding piece or pieces of equipment. As the knob 110 is rotated by that position and through the pump OFF position where dot 132 on the control knob passes the pump OFF dot 128, dot 132 becomes aligned with dot 131 adjacent the letter J for jets, microswitch C (microsw. C) is activated so that its plunger 127C projects into a flat or depressed area of the shaft 120 to change its state. When control knob 110 is rotated a full 180 degrees clockwise to a position where the indicator dot 132 on control knob 110 is most remote from indicator dot 128, and aligned with a dot 131A, marked T/F (temp/filter). In this position microswitch A plunger 127A extends into a flat or recessed area of shaft 120. Microswitch A receives 12 volt D.C. from thermostat switch 2A of 2. Then microswitch A transfers that power to relay coil 22*b* and contacts 22a give power through relay contacts 23a to the pump motor 35.

In this position, thermostat contacts 2a control both relays 21 and 22 simultaneously. This provides filtration and heat to the circulating water as the water temperature drops slightly to automatically maintain the water quality.

When knob 110 is in the OFF position, all microswitch plungers are depressed and their contacts are open. In filter position, the plunger for microswitch B extends, but those for microswitches A and C remain depressed. In knob 110 position J (jets) both plungers for microswitches B and C extend leaving the plunger "A" depressed. In the T/F (temp/filter) mode, microswitch plunger of microswitch "A" extends and microswitches B and C become depressed. The design of shaft 120 (or shaft 130) is simple in operation, trouble free, and will not allow operation of equipment or microswitch plungers other than at the shaft depressions.

Shaft 120 extends downwardly to one side of three microswitches A, B, C and the shaft 120 includes a reduced diameter of terminal portion 120C which projects through a suitable small diameter hole within a thin metal shaft stabilizer or plate 133 which is of trapezoidal configuration and which abuts the bottom of microswitch C, supporting all three microswitches A, B, C of array 126 and through which the screws or bolts 127 pass. The shaft stabilizer 133, being attached by the microswitch mounting screws 127 keeps the shaft 120 in proper location and eliminates any end movement of the shaft which would occur if the knob 110 is removed for service or replacement of the O-ring 124. A similar arrangement is provided for control knob 111. Shaft 130 includes a reduced diameter portion 130c which projects through an appropriate hole within the shaft stabilizer or plate 134 of stacked microswitch array 135 defined by a pair of similar microswitches D, E for blower/light unit 4. The shaft stabilizers 133 and 134 eliminate any wobble which may occur to shafts 120 or 130.

A cylindrical hub 136, fixed to the panel face 93a, is partially received by a cylindrical recess 137 within knob 111 and the shaft 130, like shaft 120, is mounted to its control knob 111 by way of the same double set screw arrangement illustrated in detail for the first control knob 109. The microswitches D and E form a second, stacked microswitch array 135. Microswitch plungers 138D and 138E abut the periphery of shaft 130. Microswitch mounting screws 139 mount microswitch array 135 in the same manner as screws 127 for array 126 to cover 93. The mounting screws pass through aligned holes within the shaft stabilizer 134 and associated microswitches D, E. Further, hub 136 carries a groove 140 on its periphery which receives an O-ring 141 which is sandwiched between the hub groove 140, and the side of cylindrical recess 137, preventing the ingress of water into and about the shaft 130 and the prevention of the liquid entering the interior 101 of housing 92. Blocks 112, 121 and 136 constitute hubs for the rotating control knobs 109, 110, 111, respectively.

With respect to control knob 111, shaft 130 and microswitches D, E, as the control knob 111 is rotated to the left, FIG. 4, 90 degrees counterclockwise from the OFF positions at dot 143 to the index position where the indicator dot 142 on knob 111 is aligned with the "B" dot (blower), a slopping relief area or flat in the shaft 130 aligns itself with the plunger 138D of microswitch D to allow the microswitch button 138D thereof to extend sufficiently to change the state of the contacts of that microswitch. The contacts shift from open to closed condition to actuate the appropriate relay and operate a corresponding piece of equipment. In this position, indicator dot 142 is aligned with indicator dot 144, 90° counterclockwise from the blower light OFF indicator dot 143. Dot 144 has a letter B adjacent thereto, indicating that the equipment energized is the blower 36, FIG. 2. As the control knob 111 is rotated from the OFF position shown in FIG. 4 clockwise to the right by 90 degrees, where dot 142 aligns itself to dot 145 adjacent lett L (light), a second slopping relief area or flat aligned with the microswitch plunger or button 138E causes that plunger or button to extend changing the state of microswitch E to energize the relay associated with a second piece of equipment, in this case spa light 37. As may be further appreciated, rotation of the control knob 111 a full 180 degrees from the OFF position shown in FIG. 4 to a position where knob dot 142 aligns itself with dot 145a adjacent the letter B/L (blower-light) causes a pair of flats or slopping relief areas in the shaft 130, such as flats or relief areas 130a, 130b, FIG. 7, to be simultaneously aligned with respective microswitch buttons or plungers 138D, 138E to energize both relays simultaneously and energize both respective pieces of equipment (blower 36 and the spa light 37). Thus, knob 111 controls two pieces of equipment selectively or simultaneously depending upon its rotary adjusted position. When rotated clockwise by 90 degrees from the OFF position, the indicator dot 142 on the knob 111 aligns with the indicator dot 145 adjacent the letter L, that letter signifying, at that knob position, the energization of the spa light 37. Alternatively, instead of the two pieces of controlled equipment being the spa light 37 and the air blower 36, the two pieces of equipment could be a low speed pump for filtration and heating and a high speed pump for jet action using respective microswitches D and E.

Figure 5:
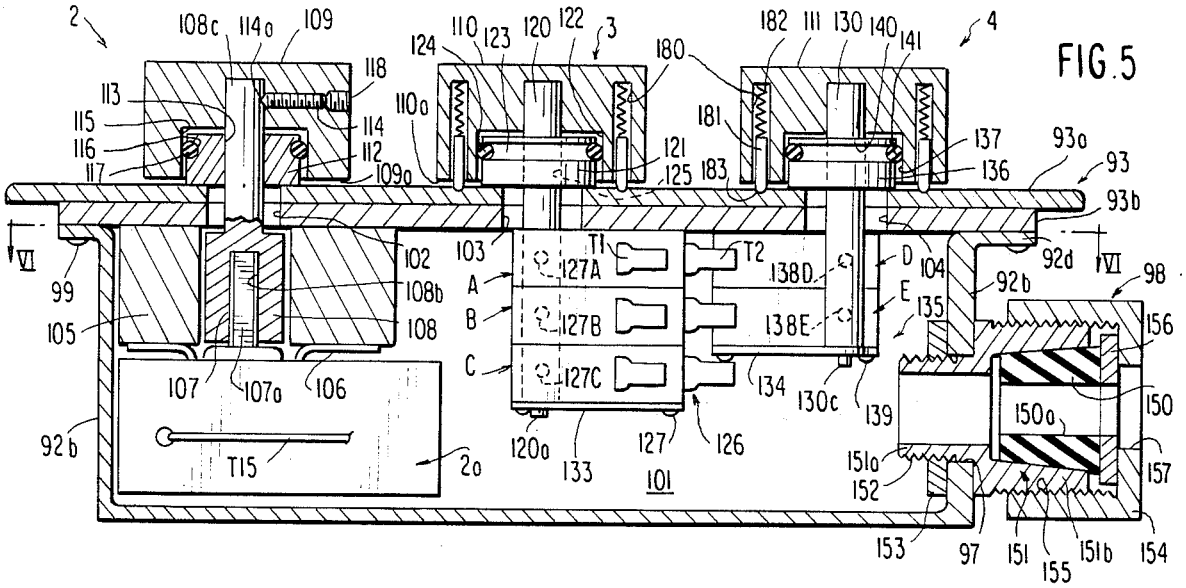
FIG. 5 is a longitudinal sectional view of the spa side control unit of FIG. 3, taken about lines V—V.
Figure 6:
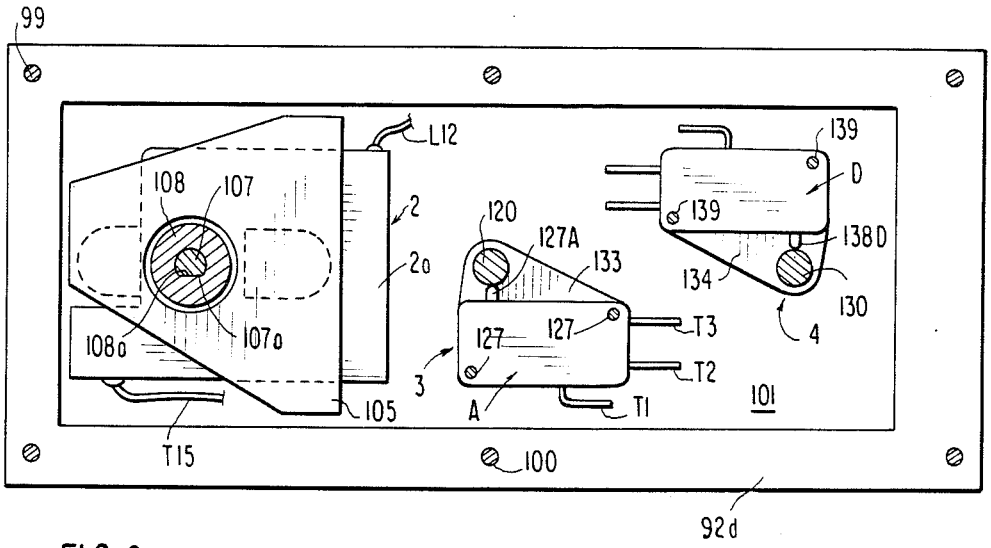
FIG. 6 is a horizontal sectional view of the spa side control unit of FIG. 5 taken about lines VI—VI.
Figure 7:
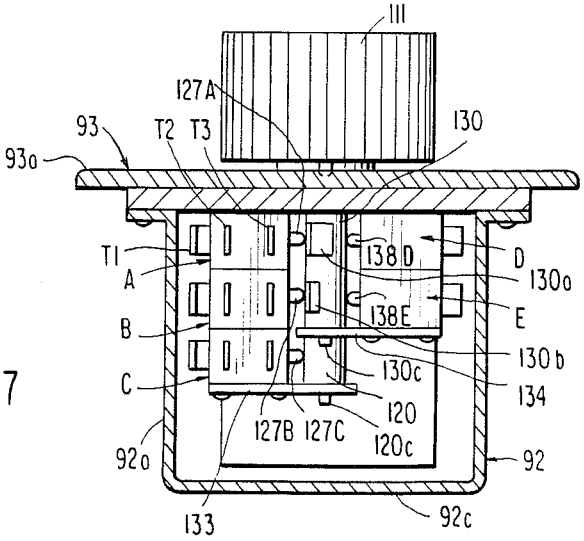
FIG. 7 is a transverse, vertical sectional view of a portion of the spa side control unit shown in FIG. 5.

In the illustrated embodiment, the second control knob 110 from the right, FIG. 5, functions to control a low speed pump for filtration and heating, and a high speed pump for jet action. In that respect, in the illustrated embodiment, FIG. 9, the pump 35a includes an electric pump motor 35 which is provided with winding whose connections are changed for pump motor high speed and low speed operation via lines L 7 and L 29. Microswitch C functions to change the pump motor from low speed to high speed operation by energization of the microswitch B for applying power to relay contacts 23a. Microswitch C operates to shift contacts 23a to charge low speed pump operation to high speed. A third microswitch A is placed in series with control thermostat 2 to effect low speed pump mode in response to the temperature of the spa water. As will be seen hereinafter, this insures circulation of the water by low speed mode operation of pump motor 35 and operation of heater 65. Shaft 120 is provided with a series of flats at longitudinally spaced positions aligned with microswitch plungers 127A, 127B and 127C similar to those flats 138D, 138E illustrated in FIG. 7 on shaft 130. In FIG. 7, shaft 120 is partially hidden and only the bottom portion of that shaft is shown. When the control knob 110 and the shaft 120 affixed thereto are rotated 180 degrees to the right or left, the low speed pump relay 22, FIG. 4, is energized with the indicator dot 132 on control knob 110 rotated to a position most remote from the fixed pump OFF indicator dot 128, and is aligned with indicator dot 131a on panel 93. The low speed pump relay 22 is energized providing the thermostat temperature setting of thermostat switch 2a is higher than the temperature of the water W. Under these conditions the thermostat switch 2a contacts will energize relay 22 and the relay 22 contacts close (simultaneously) with the heater controls. If the pump 35A is running and a pressure switch within the heater is closed, the thermostat 2 controls the heater 65. With the knob 110 rotated 180 degrees from the pump OFF position as shown in FIG. 4, the thermostat 2 will control both the pump 35 low speed and heater 65 operation. This may be appreciated by further reference to FIGS. 9 and 10 which will be described hereinafter.

In order to make appropriate electrical connections between the control system components, such as the thermostat switch 2a, and microswitches A through E, inclusive, suitable electrical connections must be made between those components and the other system components. In that respect, thermostat switch 2a includes a capillary tube which extends to a temperature-sensitive (T/S) bulb mounted within the thermostat well 66. Each of the microswitches A through D are provided with three contacts or terminals, T1, T2, and T3. For simplicity purposes, only the terminals T1, T2, T3 for microswitch A are labelled in FIGS. 5, 6, 7 and 9. Preferably the housing 92 is attached and sealed by way of a gasket of silicone (not shown) to the rear of cover 93. Further, the connector 98 is suitably provided with a rubber grommet 150 sealing the electrical leads to the interior 101 of housing 92 which adequately seals off the housing interior 101 to the exterior (or the interior of the sand protector shield if such is used). As shown in FIG. 5, a cylindrical connector body 151 includes a reduced diameter portion 151a which is threaded at 152 on its outer periphery. Portion 151 projects through the circular hole 97 within end wall 92b of housing 92 and a locknut 153 is threaded to the reduced diameter section 151a to lock the cylindrical connector body 151 to end wall 92. The outer periphery of a larger diameter portion 151b of body 151 is threaded and carries a cup-shaped cap 154, which is threaded on its interior. The cup-shaped cap 154 includes a through hole 157 and carries internally a washer 156 having an inner diameter smaller than that of through hole 157 and an outer diameter which is less than the inside diameter of the cup-shaped cap 154. Thus, when the cap 154 is threaded to the enlarged diameter section 151b of the cylindrical connector body 151, the washer 156 exerts compressive force on the frustoconical rubber grommet 150 tending to reduce its internal diameter and to effectively seal the grommet about the electrical leads passing therethrough. Meanwhile locknut 153 maintains the connector member 151 locked to end wall 92b of the housing 92.

Figure 8:
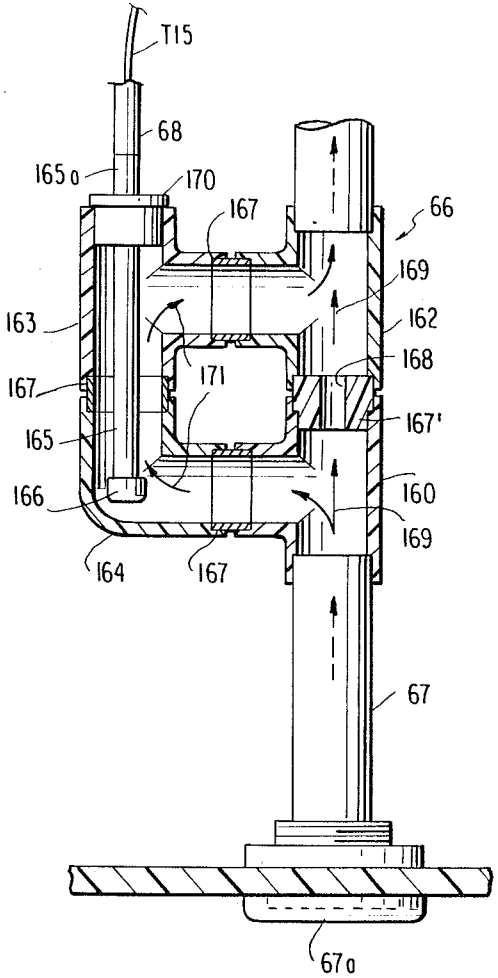
FIG. 8 is a sectional view of the thermostat well forming a principal component of the spa construction of FIG. 2.

Turning to FIG. 8, there is shown in detail thermostat well assembly 66 which facilitates the accurate measurement of the temperature water circulating within the circulation loop formed by suction pipe 67. Suction pipe 67 opens to the interior of the shell 61 via a suction inlet fitting 67a. The improved, simplified thermostat well assembly 66 consists of commercially available molded plastic components including: three two-inch PVC tees, 160, 162 and 163; one 2-inch 90° ell 164, a given length of ½" PVC pipe 165, and a ½" pipe cap 166. In addition and necessarily, suitable nipples 167, 167' are used in making the connections between the thermostat well assembly components.

As seen in FIG. 8, the suction pipe 67 is severed to provide a gap within that pipe adjacent to the suction inlet fitting 67a. The straight through sides of two of tees 162 are oriented in the same direction, and are coupled end to end by a nipple 167' (integrated with a reducer) to provide a short length small diameter passage 168 for the water passing therethrough as indicated by arrows 169. The straight through side of the other 2" tee 163 is connected to the two inch 90° ell 164 using a 3" PVC nipple 167. At the opposite end of the tee 163, a 2"×½" reducer 170 is provided. The ½" reducer 170 sealably receives the ½" pipe section 165. One end of the ½" pipe 165 extends through nipple 167 which joins ell 164 to the tee 163. The ½" pipe cap 166 closes off the end of ½" pipe 165 adjacent to the bend in the ell 164. Appropriately, 3" long - 2-inch diameter PVC nipples 167 are employed in connecting one end of ell 164 to tee 160, and the tees 162, 163 to each other. In the illustrated embodiment, the ½" PVC pipe 165 may be about 8" long and glued into the reducer 170 with a portion 165a of the pipe 165 protruding outwardly of the reducer 170 parallel to the suction pipe 67. That portion may be sealably coupled to similar sized pipe 68. The ½" pipe section 165 defines a thermostat well. Preferably it is filled with a non-hardening conductive grease and a capillary thermostat (temperature sensing bulb 26) is positioned internally so that the diverted water flowing as indicated by arrows 171 about the outside of the pipe or thermostat well 165, will conduct its heat adequately to the thermostat (bulb 26, FIG. 9) internally within the pipe 165 so that an expanding fluid actuates through capillary tube 15 the thermostatic switch 2a, within housing 92. The ends of the various tees, and the ell are appropriate recessed internally to facilitate mounting of the nipples 167, 167' joining the PVC plastic molded pipe or tube components using an appropriate non-water soluble adhesive.

As seen in FIG. 8, the utilization of the thermostat well defined by small diameter PVC pipe 165 and the isolation of the same from the water fluid flow has a two-fold effect. The thermostat sensor bulb 2b and capillary tube T 15 and housed within the interior of the thermostat well 165 may be readily removed and replaced when defective without interfering with water flow. Further, the water flow is effectively diverted by the reducer integrated into the nipple 167' to ensure that the thermostat of well 165 is sensing the mean temperature of the suction flow to the pump through suction line 67. The flow is not reduced, simply diverted to the thermostatic well 165. The ½" pipe or well 165 may be extended in length so as to run completely to the sand protector shield 91 or may be coupled to the end of pipe 68 as shown in FIG. 8.

A ½" PVC electrical conduit may form line 68. The length of the ½" PVC thermostat well will be controlled by the length of the capillary tube and placement of the thermostat well assembly at the spa 60. The thermostat well assembly, facilitates the removal or replacement of thermostat bulb 2b or thermocouple with the spa installed in the ground. The presence of the thermostat bulb or other temperature sensor does not restrict the flow of water and the life of the thermostat bulb or equivalent sensor is increased significantly by isolating it from the corrosive effects of any chlorine or bromine carried by the circulating water W.

Referring to FIG. 5, knobs 110, 111 are illustrated as having diametrically opposed small diameter, right angle holes 180 drilled into the knobs from the lower faces 110*a*, 111*a* respectively which holes carry detent pins 181 backed by coil springs 182 biasing the pins downwardly. The ends of the pins, which are rounded, are selectively received within semispherical recesses 183 within the panel face 93 to act as detents, the recesses being spaced in a circular array at angular positions corresponding to the indicator dots 128, 129, 131 for control knob 110 and indicator dots 143, 144, 145 for control knob 111.

Figure 9:
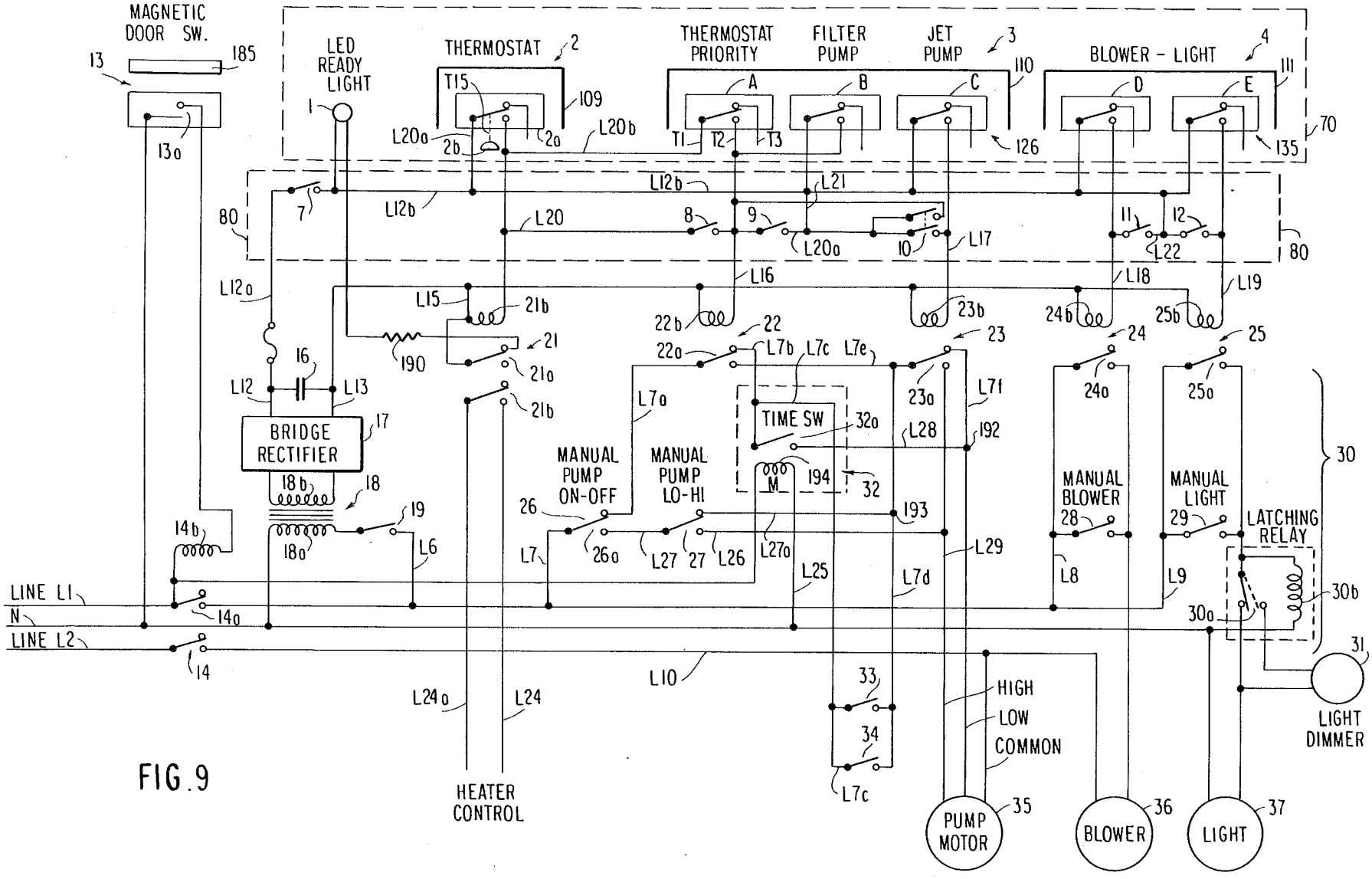
FIG. 9 is an electrical schematic diagram of the control system for the spa of FIGS. 1 through 8, inclusive.

Referring next to the electrical schematic diagram in FIG. 9, many of the components shown therein have already been described in some detail conjunction with FIGS. 1 through 8 inclusive. The electrical power for the system emanates from a standard 230 volt AC power line 184 consisting of a neutral line N, and two hot lines lines L1, L2, each at 115 volts relative to neutral N. Hot line L2 is at 115 volts with respect to neutral but at 230 volts relative to line L1. The main power line 184 feeds to the main control panel 30 normally within the equipment area 79. The main control panel 30 of FIG. 2 includes a control panel cabinet door 183 which when opening and closing, actuates a magnetic door switch 13, FIG. 9. The main control panel cabinet door 183, FIG. 2, carries a permanent magnet 185 which acts to close normally open magnetic door switch contacts 13*a* of the magnetic door switch 13 upon swinging of the door 183, FIG. 2, from open to closed position. Switch contacts 13*a* in closing, energize the relay coil 14*b* of the main contactor 14 for the main control panel 30. With the main contactor relay coil 14v de-energized, electric power is limited to the magnetic door switch 13 and time switch 32 motor 194 via line L 25 across main power line L1 and neutral N. With contactor 14 relay coil 14*b* energized, power is restored to the other components of the control system.

Preferably the main control switch panel 30 includes, as an element therein, a key operated vacation switch 19 which connects, via line L 6, the primary coil 18*a* of low voltage circuit transformer 18 to line L 1. The secondary coil 18*b* of the transformer supplies alternating current at 12 volts to the bridge rectifier 17 via lines L12, L13. Across lines L12, L13 is filter 16 which provides a low voltage DC, the filter 16 being a 50 mfd capacitor. A one amp fuse 15 is provided within line L12 leading to the in-house vacation switch 7 which is housed within the in-house control panel 80.

The in-house control panel 80 is provided with a number of one amp toggle switches 7 through 12 inclusive. Vacation toggle switch 7 may be manually opened in the house to terminate energization of the balance of the manually operated toggle switches 8 through 12, these switches using low voltage to control the heater, the blower, the light, filter pump, and the jet pump. Toggle switch 8 constitutes an in-house heater priority switch, switch 9 is the in-house filter pump switch and switch 10 is the in-house jet pump switch. In house switch #10 must be a double pole single throw switch to energize both relay coils 23B and 22B. Line L 21 must connect to line L 12*b* as Line L 20*a* connects to line L 12*b*. In house switch #7 also terminates low voltage power to all the spa side controls—the ready light thermostat #2, pump control microswitches of unit #3 and blower/light microswitch of unit #4. The ready light #1 is part of the spa side unit 70. Toggle switch 11 is the in-house blower switch and toggle switch 12 is the in-house light switch for controlling energization of a spa light 37. Further, the vacation in-house toggle switch 7, when open, disables operation all of the remaining house switches plus all of the relay switches of the complete spa side control unit 70. As such, the spa side control unit 70 of any spa 60 installed outside of the house 78 may be selectively disabled by the owner when away from home on a regular basis. Main control panel vacation switch 19 achieves the same end at the outside control panel 30, limited to the low voltage relay controls. The use of a vacation switch (otherwise known as the privacy switch) is believed to be a new concept. However, the control system of the present invention ensures that when the vacation switch 7 is in the "OFF" position, the time control switch 32 and the switches at the main control panel 30 within the equipment area 79 will still be operative.

The thermostat switch 2*a* controls the flow of low voltage (12v) current through relay coil 21*b* of relay 321 in response to closure of the switch contacts of the thermostat switch 2*a* to switch the top set of relay contacts 21*a* out of line L15 which includes the relay coil 21*b*. Line L16 includes relay coil 22*b* with microswitch A in series therewith. Coil 23*b* of relay 23 is connected in series across lines L12B, L13 via line L17 through microswitch C. Line L18 connects microswitch D in series with a relay coil 24*b* of relay 24. Line L19 connects the relay coil 25*b* of relay 25 in series with microswitch E and across lines L12, L13.

Additionally, line L20 branches from line L15A intermediate of the relay coil 21*b* and thermostat switch 2*a*, connects to line L16 and includes normally open the in-house heater priority toggle switch 8, bypassing microswitch A. Line L20*a* connects toggle switch 9 to both poles of switch 10. Midway of line L 20*a* is line L 21 which connects to line L 12B. Line L 21 continues to microswitch B, bypassing microswitches B and C. Line L 21 connects line L20*a* to one side of the microswitch B, the opposite side being connected to line L16, intermediate of the relay coil 22*b* and the microswitch A.

Line L21 must connect to Line L12*b*.

Line 20*b* connects line L 20 and thermostat microswitch 2A to microswitch A. Thus, when thermostat microswitch 2A closes and energizes relay coil 21*b*, power is delivered to toggle switch 8 and microswitch A under thermostat priority.

Further, line L22 is connected at one end to line L18 via toggle switch 11 intermediate of relay coil 24*b* and microswitch D, and its opposite end is connected to line L19 through toggle switch 12 at a point between relay coil 25*b* and microswitch E.

It should be kept in mind that, for main control thermostat 2, control knob 109 rotation sets the signal intensity and thus the temperature required to shift the contacts from the open position shown in FIG. 9 to a position energizing relay coil 21*b*. Likewise, rotation of control knobs 110 and 111 for the microswitch arrays 126, 135, respectively, causes in a selective manner, one or more of the microswitch switches A, B, C, D and E to change state and to close the normally open contacts thereof. With the exception of the LED ready light 1, this describes the connections to the low voltage components of the control system. The LED ready light 1 is on the spa side unit 60 and will be energized if the water in the spa 60 is at a higher temperature than or at the same temperature of the thermostat 2 setting. When the thermostat 2 setting is higher than the spa water temperature, the thermostat switch 2*a* changes state causing a current to flow through line L15 to relay coil 21*b* of relay 21 and line L 15A and thermostat 2*a* through to line L 12*b* changing the state of the double-pole double-throw switch contacts 21*a* of relay 21; the result of which is to open the circuit through a resistor 20 to the LED ready light 1 and to close contacts 21*b* to the heater 65 via lines L24 and L24*a*. A resistor 20 in series with the LED ready light 1 reduces the 12 volt available voltage across the light to 2½ volts.

On the high voltage side of the circuit, there are provided a number of manual remote switches 26, 27, 28 and 29 mounted within main control panel 30 at equipment area 79 which are normally open, a time control switch 32 and a pair of freeze thermostat switches 33, 34. The manual pump ON/OFF switch 26 is connected to line L1 via line L7. Line L7*a* connects the normally closed contacts of switch 26 to the common of contacts 22*a* of relay 22. Freeze thermostat switch contacts 33 and 34 lead to the pump motor 35 low speed motor windings. The time switch 32 normally open contacts 32*a* are connected through normally closed relay contacts 22*a* to manual switch 26 by line L7*a* and through switch 26 to line L7. Time switch contacts 32*a* provide power to the pump motor low speed windings at point 192 by line L28 of pump motor 35, bypassing the two freeze thermostats and relay 23 high voltage contacts 23*a*. Manual low to high speed switch 27 is connected in series with a manual pump ON-OFF switch 26 via line L27 through switch 26 line 7. Switch 27 provides power through line 27*a* to the low speed windings of 35 at point 193. Line L26 connects the normally open contacts of low to high speed manual switch 27 to line L29 which leads to the high speed windings for the pump motor 35. Twelve volt D.C. power at low voltage in the house and spa side control unit insure the safety of the spa user.

In normal switch position, power travels form line L1 through contacts 14*a*, line L7, switch 26 line L7*a* and normally closed contacts 22*a* of relay 22 to time switch contacts 32*a* by line L7B and also through line 7*c* to freeze contacts 33 and 34 to line L7D to line L7E to relay contacts 23A then through normally closed contacts to pump 35 low speed line L7F.

The switch of the relay coil contacts 22*a* of pump relay 22 results in operation of pump 35 at low speed, through line L7E.

The manual switches 26 through 29 which are located within control panel 30 at the equipment area 79 perform two basic functions. They control all of the pieces of equipment within the equipment area, and they ensure operation limited to the high voltage portion of the wiring circuit. The manual pump ON/OFF switch 26, in bypassing the relay contacts 22*a*, 23*a* of relays 22 and 23, respectively, shifts control of system operation from the time switch contacts 21*a* to manual low to high speed switch 27. This ensures that the spa side control unit 70, the in-house control panel 8 or the time control switch 32 will not be able to energize the pump motor 35 while the manual switches 26, 27 are being actuated. The function of manual low to high speed switch 27 is to switch the water circulating pump 35 from a condition where its low speed windings are energized to one where its high speed windings are energized. In that respect, one of the switch 27 stationary contacts connects to line 27, bypassing the freeze thermostats 33, 34 in line 7. The other stationary contact connects to the high speed windings of the pump motor 35 via line L29, through line L26.

Manual blower switch 28, on closing, energizes the blower 36 via line L8, bypassing the relay 24 contacts 24*a*. Manual light switch 29, on closing, energizes the spa light 37 via line L9, bypassing the relay switch contacts 25*a* of relay 25. Upon closing of the manual light switch 29, the relay coil 30*b* of a latching relay 30 is energized to switch contacts 30*a* removing a light dimer 31 from the circuit with the spa light 37.

Also, the normally open manual switches 26–29, by being arranged in the high voltage section of the wiring circuit are of value in diagnosing problems in the system. For instance, if the spa light 37 cannot be energized from the spa side control unit 70 or the in-house control panel 80, but can be energized by way of the manual light switch 29, then the problem is recognized as one occurring in the low voltage wiring or relay 25. The manual switches 26, 28 and 29 are preferably single pole double throw center off switches. Switch 26 eliminates low voltage control of the pump motor 35 and prevents it from being run from switch 27. If single pole double throw, center off switches 28 and 29 are used and relays 24 and 25 wired similar to manual pump ON/OFF switch 26, they would eliminate low voltage control for the blower and light and would not have equipment running in the "OFF position".

The time control switch 32 parallels the contacts of relay 22 and runs the pump motor 35 at low speed. If relay 22 should become energized from the in-house control panel 80 or the spa side control unit 70, the source of power to the time clock contacts of time switch 32 would be de-energized and the pump 35 would continue to run with the circuit completed through operation of relays 22 and 23. It should be noted that the timer motor 194 is powered at all times, since line L25, connected to neutral N also connects to line L1 ahead of the main contacts 14.

Preferably the freeze thermostat switches 33 and 34 have 20 amp contacts and they are capable of running a two horsepower pump via pump motor 35 by direct closure of the normally open thermostat contacts thereof, without the necessity of relays. The freeze thermostats 33, 34 are parallel to the time switch 32 and run the pump 35A at low speed using line voltage. The system of the present invention permits the use of line voltage freeze thermostats which have definite advantages. In the past, known freeze thermostats have been employed on the low voltage side of the control circuit and often the low voltage components fail and create the need of freeze protection as the water temperature becomes colder and colder. Since the freeze thermostats 33, 34 of this invention are in the high voltage side of the circuit they ensure pump motor operation irrespective of shut down of the low voltage side of the control circuit.

With respect to the embodiment of the invention shown in FIGS. 1 through 9 inclusive, the time control switch 32 may be an INTEMATIC TM series T100 R201 swimming pool time switch including an auxiliary thermostat switch which is capable of turning off the heater 65 twenty minutes before the pump motor 35 is de-energized. This allows the heater 65 to cool down to conserve energy and reduce liming of the heater. Further a time control switch without auxiliary heat contacts may be programmed to run the circulating pump 35A for a time-longer than necessary to heat the water which in effect amounts to a heater cool down cycle.

The freeze thermostats 33, 34 maybe White Rogers' commercial, remote bulb thermostats under model designation 2B 61-186. Such thermostats are capable of running a two horsepower pump at 230 volts. They have a contact rating of 20 amps. These thermal switches can be set to close at 40° F. and open at 50° F. A bi-metal type thermostat may be substituted therefor. They are of the single pole single throw contact type. A double pole single throw contact type could be used. A single pole unit would be used for 115 volt pump motors while a double pole unit may be used for a 230 volt pump motor or a two pump system to provide freeze protection. A bi-metal thermal switch assembly could be used, the bi-metal unit is placed into a plastic (PVC) two part capsule with the wires extending through the capsule at the seam or through holes provided within a capsule half. The other half of the capsule would be glued to the first and the wires would be sealed with suitable sealant to eliminate water infiltration into the capsule to the bi-metal switch unit, the sealant used could be silicone. The assembled thermal freeze switch would then be attached preferably to the bottom area of the plumbing most subject to freezing. It may be attached by a heat-conductive pliable material (duct seal) and plastic electrical tape. If the spa is installed in the ground as shown in FIG. 1, a PVC pipe capped at its end and the end with the cap attached with duct sealant and tape to the area of the plumbing most likely to freeze and the thermal switch capsule forced down the pipe to the end thereof, the bi-metal switch would sense the temperature at the critical area.

In operation, with the manual remote switches 26–29 in the condition as shown in FIG. 9 with the system under remote control, and with the control 32 switch contacts **32*c* open as well as the contacts of freeze thermostats 33, 34, operation is as follows. The occupant of the spa rotates the pump control knob 110 of the temperature/priority unit 4 on the spa side control unit 70 from the "OFF" position, FIG. 4 counterclockwise, to a position where the knob indicator dot 132 aligns with the face plate indicator dot 129. Microswitch contacts of microswitch B switch, causing a current to flow to the pump relay 22 winding 22*b*. Power then flows through the circuit from the high voltage line L1 through manual remote switch 26 via the now switched, switch contacts 22*a* to the contacts 23*a* of relay 23. With relay 23 de-energized the high voltage current flows via line L7*f* to the low speed winding of the pump motor 35 and through common to L2 of main power line L2 via line L10. Pump motor 35** runs at low speed.

When relay coil **22*b* of relay 22 is de-energized (as shown), and a manual switch 26 is in the remote mode (as shown), a circuit exists through from high voltage line L1 through the manual pump ON/OFF switch 26, through a normally closed contacts 22*a* of relay 22 to normally open time control switch contacts 32*a* in line L17*b*. A circuit exists also to the freeze thermostat switch contacts 33 and 34, L17*c*. If any of time switch contacts 32*a* or freeze thermostat 33 or 34 contacts close, the low speed windings of the pump motor 35 are connected across main power lines L1, L2 via lines L7*f*, L10**.

When relay coil **22*b* becomes energized, the relay 22 switch contacts 22*a* switch and power is lost to the freeze thermostat contacts 33, 34 and the time switch contacts 32*a*. Thus energization of relay 22 prevents the time switch 32 or one of the freeze thermostat 33, 34 switches and relay 23** from attempting to run the pump motor at both speeds simultaneously.

When the control knob 110 is rotated 180° from the "off position", FIG. 4, the contacts of microswitch A switch, and those of microswitches B and C remain as shown (open). As a result, microswitch A will cause a current flow to relay coil **22*b* of relay 22 at any time power is supplied from line L12B via thermostat switch 2*a*. Under these conditions, relays 21 and 22 are both controlled by the thermostat switch 2*a* operated by the thermal bulb or a similar sensor within thermal well 165, FIG. 8. As the temperature of the spa water W drops below the thermostat setting, the switch contacts of thermostat switch 2*a* close energizing relay coil 21*b* of relay 21 to cause the heater 65 to be energized via line L24 and L24A with switching of the double-pole switch contacts 21*a* of relay 21. Simultaneously the pump motor 35 is energized through microswitch "A" of 3 which circulates the water through the heater 65. When the water reaches the temperature of the thermostat setting, the switch contacts for thermostat 2*a* open to de-energize the heater 65 and terminate operation of pump motor 35**.

When the control knob 110 is rotated 90 degrees to the right of OFF, where dot 132 is aligned with dot 131, the contacts of microswitch A are moved to open, contacts of microswitches B and C close, relay coils **22*b* and 23*b* are energized and the power delivered through relay contacts 22*a* is transferred to contacts 23A and via line 29 to the pump motor high speed windings. The relief area (of shaft 120) allows microswitch button to extend and the contacts of microswitch B to close sooner than microswitch C. The rotation of control knob 110 to jet position, the design of and location of the flats on the shaft ensures that the microswitch B operating the motor 35 at low speed will energize and start the pump at low speed slightly before microswitch C takes over. This will switch the pump via relay contacts 23*a*** to high speed and will increase the life of the motor and reduce hydrostatic shock to the system.

When the control knob 111, shown in the off position in FIG. 4, is rotated 90° clockwise from the position shown to where the indicator dot 142 on the knob 111 is moved to a position adjacent the indicator dot 145 on the face plate **93*a*, microswitch contacts of microswitch E close causing energization of the relay coil 25*b* of relay 25. When the relay coil 25*b* is energized, the normally open switch contacts 25*a* of relay 25 close and power is supplied to the latching relay 30. Latching relay 30 is the type where the contacts remain in their changed state after switching until reswitched. Relay 30 may be a Potter Bunfield S89R5ABDI-120 voltage relay. Relay coil 30*b* causes the switch contacts 30*a* to switch from the full line position shown to the dotted line position whereby current flow is through the light dimer or diode 31 to the spa light 37. When power from relay 25 terminates the contacts of the latching relay 30 remain in their last position (in the dotted position) when power is restored again from relay coil contacts 25*a* to the latching relay coil 30*b* and the common of the contacts of the latching relay 30, the contacts 30*a* move and power is passed directly to the spa light 37. When power is terminated from relay 25, the latching relay contacts 30*a* remain in their last position. When a dimer (variable resistor) is used in the circuit at 31 in place of a diode, the light intensity could be varied by the spa owner, and from the spa side control. The user would have the ability to have full brightness or the pre-set lower level lighting via the dimer. The use of a diode at 31 causes one-half of the sine wave of the current to pass which gives one-half brightness. The presence of the diode 31 in the circuit reduces the voltage across the spa light 37** and provides about ½ brightness.

By rotating control knob 111 back to "OFF", the relay coil 25b is de-energized. Under these conditions, the latching relay 30 contacts remain in their past position. When the diode or dimer 31 is in series with the spa light 37, and power is being delivered from relay 25a and the light will be one-half brightness.

When control knob 111 is rotated 90° to the left, counterclockwise to that shown in FIG. 4, microswitch D contacts close causing energization of the relay coil 24b by the 12 volt DC source, lines L12B, L13. As a result, relay switch contacts 24a close to complete a high voltage circuit through lines L8 and L11 placing blower 36 across the main power lines L1, L2.

When the control knob 11 is rotated 180° from the off position, FIG. 4 flats on shaft 130 ensure that plungers 138D, 138E of respective microswitches D, E move to their fully extended position causing both microswitches D and E to change state and simultaneously energize blower 36 and the spa light 37 by energization of the relay coils 24b, 25b of relays 24, 25 respectively.

Figure 10:
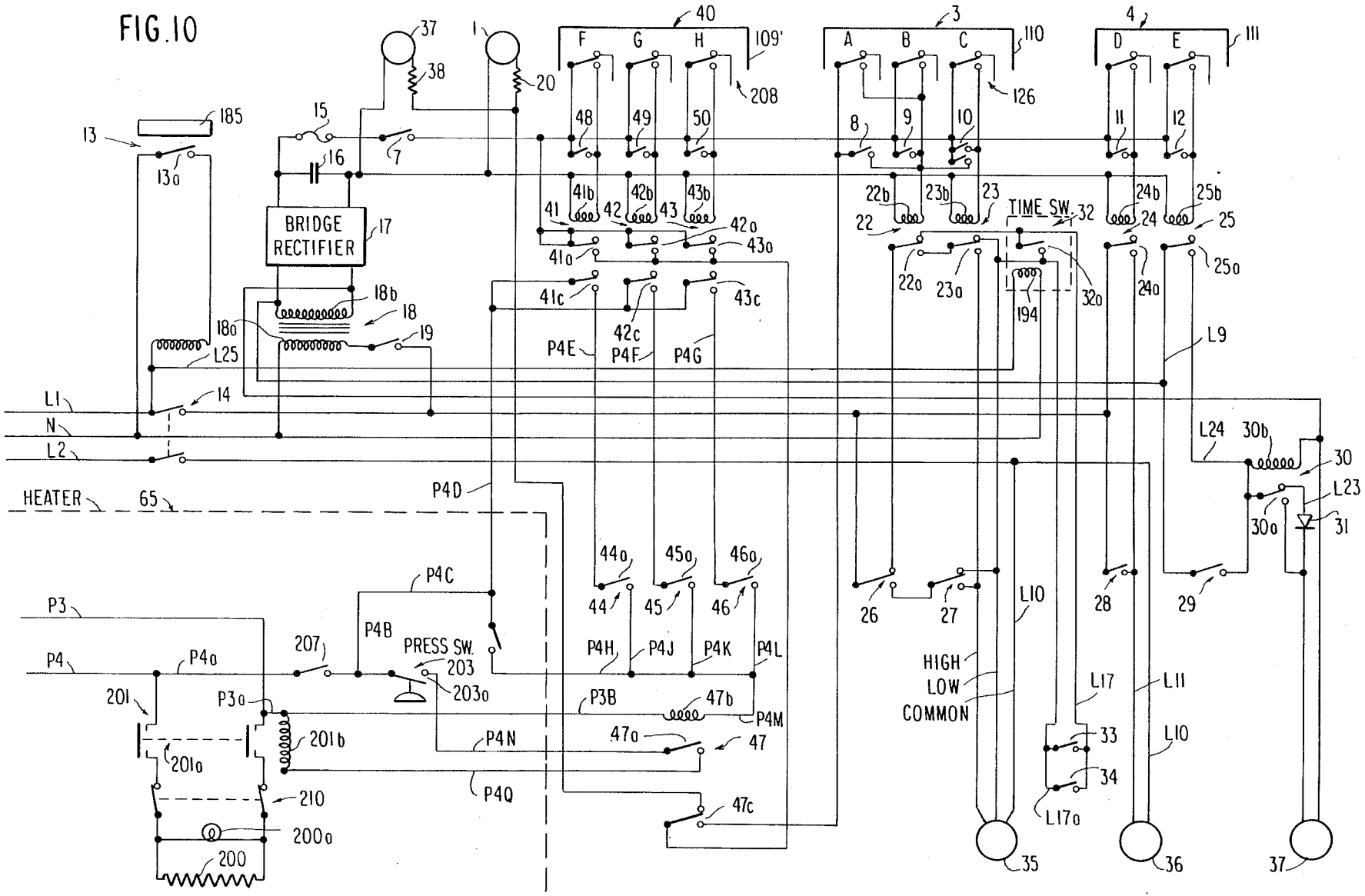
FIG. 10 is an electrical schematic diagram of an alternate form of control system for the spa illustrated in FIGS. 1 through 8, inclusive, and forming a further embodiment of the present invention.

Reference to FIG. 10 shows an electrical schematic diagram of a modified form of control system using most of the contents of FIGS. 1 and 2, forming another embodiment of this invention and having general correspondence to the wiring diagram of FIG. 9. In the embodiment of FIG. 10, like elements have like numerical designations to that of FIGS. 1 to 9, inclusive. The major differences reside in the elimination of the thermostat 2 at the spa 60 and the bolt within the thermostat well 66. The system includes selective control of the heater, by a thermostatic switch at the heater or any of three other thermostatic switches located near the heater and other equipment. The setting of each of the thermostats may be preset by the spa owner or operator. For purposes of simplification in FIG. 10, while all of the principal components of the control system and associated equipment are numbered other than the main power lines L1, L2 and the neutral N and for the high voltage side of the control system and power lines P3, P4 for powering the heater element, the low and high voltage lines are unnumbered. Further, other than in accordance with the specific description hereinafter, the equipment and components of the control system of FIG. 10 operate identically to that of FIG. 9.

The circuit of FIG. 9 may include an L.E.D. light at the in-house control unit 80, as shown in FIG. 10.

Unlike FIG. 9, however, in addition to the L.E.D. light 1 at the spa side unit 70, the system is provided with a L.E.D. in-house light 39, and attendant resistance 38 which are mounted to the in-house control panel 80. Further, three adjustable setting type thermostats 44, 45 and 46 are employed for selective control of the energization of the heating element 200 of heater 65. Control power lines P4A, P4B feed through an on/off heater switch indicated generally at 207. A main contactor 201 is provided having relay contactor contacts 201a operated via contactor relay coil 201b. Further pressure switch 203 is provided in line P4 which is normally open and which is responsive to the pump operation and water flow through the heater 65. It closes in response to circulation of the water through the heater. In addition to thermostats 44, 45 and 46, there is a fourth heater thermostat 204 for controlling the operation of the heater 65 whose temperature setting may be appropriately varied and preset. The heater thermostat 204 is preferably set by the operator or owner to the lowest setting; that of thermostat 44 is set to medium heat, thermostat 45 is set to a slightly higher medium heat and thermostat 46 is set to the highest setting by the operator. Thermostats 44, 45, 46 and 204 are located within the spa heater and near the spa equipment with the setting for thermostat 204 being somewhat above freezing and most probably between 60° F. and 90° F. Thermostat 44 may be set to 96° F.; that of thermostat 45, at 99° F. and that of thermostat 46, at 102° F., for example, to be determined by the spa owners temperature reference.

A heater relay 47 is provided and includes a relay coil 47b which is energized in response to closure of the normally open contacts of any one of the four thermostats 44, 45, 46 and 204, and which in turn closes the normally open upper contacts 47a of heater relay 47 and switches the lower contacts 47c thereof. This action energizes the relay coil 201b of the heater contactor 201 to close normally open main contactor contacts 201a and energize the heating element 200. Such action occurs provided that the switch contacts 203a of pressure switch 203 are closed.

Further, in the embodiment of FIG. 10, the thermostatic switch 2a and the control knob 109' is replaced by a triple microswitch assembly or array 208 consisting of microswitches F, G, and H. The triple microswitch assembly 208 is structurewise very similar to switch assembly 126 retained from the first embodiment, as shown in FIG. 5. The normally open switch contacts for microswitches F, G, and H are open and are selectively closed by rotating control knob 109' and a shaft fixed to knob 109' operably associated with those switch contacts. With the control knob 109' set for microswitch assembly 208 such that the microswitch contacts for microswitches F, G and H are open and relay coils 41b, 42b and 43b de-energized, and the relay contacts 41a, 42a, 43a open as shown in FIG. 10, when electric power is delivered through the door switch 14 (main circuit breaker) and through the time control switch 32 or by way of any closed circuit to the pump motor 35, the flow of water through the system causes closure of normally open contacts 203a of the pressure switch, sending power to the common of switch contacts 47a, when normally open relay switch contacts 47a are closed energizing relay coil 201b of the contactor 201 to close normally open contactor contacts 201a. Thus, if the on/off switch 207 within the heater is on (contacts closed) and if the water temperature is lower than the heater thermostat setting for thermostat 204, the relay 47 coil 47b is energized. Electrical power is then provided through the normally closed contacts of high limit switches 210, to the heating element 200, also energizing indicator lamp 200a in parallel therewith. The thermostat 204 within the heater should be set by the spa owner to the lowest setting desired within the range disclosed above.

By rotating control knob 109' 90° clockwise the contacts of microswitch F will be closed by suitable cam operation through the shaft mounting the control knob 40 while microswitches G and H are maintained open. Energization of a coil 41b of relay 41 closes normally open contacts 41C to deliver 230 volts AC via lines P4D, P4E from the on/off switch 207 within the heater 65 to thermostat contacts 44a to P4J then to P4M energizing relay coil 47b, operating relay 47 and in turn control the operation of the relay coil 201b of contactor 201. When the spa water temperature is higher than the setting for thermostat 44, a low voltage (12 volts DC)

passes through the normally closed lower set of contacts 47c of relay 47 to resistor 20 and resistor 38 which drops the voltage to 2½ volts and places this lower voltage in parallel across the LED indicating lights 1 and 39.

When the water temperature drops lower than the setting of thermostat 44, the normally open contacts of the thermostat 44 close. Coil 47b of the relay 47 is energized, the dual sets of contacts 47a, 47c shift. The lower set of contacts 47c of relay 47 delivers power to microswitch A of the spa side control unit 70 and terminate power to the resistors and L.E.D. lights. When control knob 110 in this embodiment is in the heater/filter mode, power will pass through the microswitch contacts A to coil 22b of relay 22 causing contacts 22a of that relay to switch. This will operate the water circulation pump 35 at low speed. As the circulation pump starts to run, the pressure closes the heater pressure switch 203. Control voltage is then applied through ON/OFF switch 207 to contacts 203a, contacts 47a by line P4N. Contacts 47a, being closed, energized coil 210b of the contactor via line P3*a* to the other side of the 230 bolt A.C. line. Further with control knob 109' and control knob 110 set at the positions just described, thermostat 44 functions to control the pump at low speed and the heater with thermostat 44 set to a medium temperature on the order of 96° F.

When the control knob 109' is rotated 180° clockwise, the contacts of microswitch F are caused to open and the contacts of microswitch G to close, while contacts of microswitch H are maintained open. The relay coil 42b of relay 42 is energized switching the upper and lower set of contacts 42a, 42c from the positions shown in the drawing. The lower set of contacts 42c deliver 230 volts AC through thermostat 45 to the relay coil 47b of relay 47. Further the upper set of contacts 42a of relay 42 delivers 12 volts DC to the common of relay 47 and to two resistors 20 and 38 with appropriate voltage drop limiting the voltage across LED lamps 1 and 39 to about 2½ volts.

When the water temperature drops lower than the setting of thermostat 45, the normally open contacts of thermostat 45 close with the 230 volt AC energizing the relay coil 47b of relay 47. The upper set of contacts 47a and the lower set of contacts 47c of relay 47 shift from the position shown with contacts 47a closing to energize relay coil 201b of the contactor placing the heating element 200 across the lines P3, P4. (provided that pressure switch 203 is closed). The lower set 47c of the relay contacts of relay 47 switch to deliver 12 volts DC from the common to microswitch A under control of control knob 110. When spa side temperature/priority unit 3 is in the heater/filter mode, power will pass through microswitch A with its contacts shifted from the position shown to energize relay coil 22b of relay 22. The closure of relay contacts 22a causes the water circulating pump 35 to operate at low speed.

With control knob 109', and the control knob 110 in the positions described, the thermostat 45 functions to control the pump low speed for pump 35 as well as maintain energization of the heating element 200 of heater 65. Thermostat 45 should be set to a medium hot heat, as for instance 99° F.

When the control knob 109' is rotated 270° clockwise past low temperature operation, the cams on the shaft fixed to knob 109' cause the projection of the button on microswitch H and the switch contacts thereof change state from that shown in FIG. 10 and close. Microswitch H energizes the relay coil 43b of relay 43 and the upper and lower sets of contacts 43a, 43c change state. Closure of the lower set of contacts 43c causes 230 volts AC to be delivered from the on/off switch 207 within the heater to thermostat 46 (assuming the pressure switch 203 is closed). The upper set of relay contacts 43a delivers 12 volts DC from the low voltage side of the circuit to the coil 47b of the relay 47. When the spa water temperature is hotter than the thermostat setting or thermostat 46, the 12 volts DC is applied through the normally closed set of contacts to resistors 20 and 38 which drop the voltage to 2½ volts which is then applied to the LED indicating lamps 1 and 39.

When the water temperature drops lower than the setting of the thermostat 46, the normally open contacts of the thermostat 46 close and the 230 volt AC supply from the heater energizes the relay coil 47b of relay 47 to energize the heater contactor coil 201b, assuming that the pressure switch 203 is closed. The lower set of contacts 47c of relay 47 switch and cause the 12 volt DC to be applied through microswitch A of temperature/-priority unit 3 at the spa side control unit, terminating energization of the LED lamps 1, 39. When the control knob 110 is in the heater/filter mode, the power will pass through microswitch A to the relay coil 22b of relay 22.

Line L25 connects the time switch motor winding 194 to the main power line L1. As may be appreciated, the pump motor 35 is connected across the full 230 volts by way of a common line L10 to line L2. The blower 36 is connected across the main power line L1 via lines L11 and L10, through relay 24 and relay switch contacts 24a. The manual blower switch 28 is connected across the relay 24 switch contacts to permit initiation of a blower operation and energization manually on the high voltage side of the circuit. The light dimer or diode 31 is normally in the circuit with the spa light via line L 23. However, in response to energization of the latching relay coil 30, in line L24, the relay contacts switch, opening the circuit to the light dimer or diode 3l.

With the control knob 109' and control knob 110 set as just described, thermostat 46 functions to control the pump low speed as well as the energization of the heating element 200 of heater 65. Thermostat 46 should be set to such high setting as the operator desires, such as 102° F. It should be noted that in-house switches 48, 49, and 50 are provided at the in-house control panel 80 to provide the same control as microswitches F, G and H and operate similar to in-house control switches 8, 9, 10, 11 and 13 (all at control panel 80) in that respect.

The electrical circuits described above with respect to FIG. 10 provides selective control of the spa water temperature from the spa itself. The thermostats may be located within the spa heater or near the spa equipment and the preselected temperature for thermostats 204, 44, 45 and 46 respectively, may be low for thermostat 204 (above freezing), 60° F. to 90° F.; and for thermostat 44 (medium)-96° F.; for thermostat 45 (medium hot) 99° F.; and for thermostat 46 (hot) 102° F. The indicating lights or lamps 1 and 39 will be on when the control knob 109' is set to a selected temperature, medium, medium-hot or hot, if the water temperature is at or above the thermostat setting for the respective thermostats. If a thermostat 44, 45 or 46 is calling for heat, the indicating light be out. The electrical circuit also allows for automatic filtration and heating of the spa water in same manner as the embodiment of FIG. 9.

The freeze thermostats, the time switch, the in-house switches, the spa side control unit switches and the manual switches of the main control panel 30 all operate as previously described in conjuction with the embodiment of FIG. 9.

In the system of FIG. 10, the transformer will be required to be large enough to supply power to the spa light 37 (12 volts AC). The latching relay 30 will have to be to include a 12 volt AC coil and the diode 31 is required to be large enough to supply current sufficient to cause the spa light 37 to give off adequate illumination.

When control knob 111 is rotated 90° from the position shown correspondingly in FIG. 4 (blower/light off position), microswitch contacts E close and deliver 12 volts DC to the coil **25*b* of relay 25. Relay contacts 25*a* close and deliver 12 volts AC to the latching relay coil 30*b*. The contacts 30*a* of the latching relay 30 shift bypassing the diode 31 providing full energization to lamp 37. When microswitch E opens the contacts of relay 25 open, latching relay coil 30*b* becomes de-energized but the contacts 30*a* remain in the same position and no power reaches the spa light 37. The next time microswitch E contacts close and relay 25*b* is energized. Closure of the normally open contacts 25*a* of that relay causes 12 volts AC to be applied to the latching relay coil 30*b*. The contacts of the relay 30 shift and the 12 volt AC signal is conducted through the diode 31 to the spa light 37. Since the diode is in series with light 37, one half of sine wave AC current is blocked and one-half allowed to pass, thus one half of the current is allowed to pass through the diode with the light emitted from the spa light 37** being at about ½ brightness.

While the invention has been described in detail and with reference to specific embodiments thereof, it will be apparent to one skilled in the art that various changes and modifications can be made therein without departing from the spirit and scope thereof.

What is claimed is:

1. In a spa for installation exterior of a residence or like building and including a spa shell holding water, an under water spa light, water piping opening to the interior of the shell and forming a water circulating loop, an electric heater within said loop for heating circulating water, electric motor-driven pump means within said loop for circulating said water through said circulating loop piping at low and high speed, an air manifold within said spa for injecting air into the water within said spa shell, an electric motor-operated blower connected to said air manifold for supplying compressed air thereto, said electric motor-driven pump means and said electric motor-operated blower being within an equipment area in the vicinity of said spa shell, a source of electrical power for said heater, said pump means and said blower, thermostat means for sensing the temperature of the water, and control means responsive to said thermostat means for controlling the connection of said electrical power source to said heater, said pump means and said blower, the improvement wherein; said control means comprises an in-house control panel within said residence, a spa side control unit mounted to said spa shell for access by an occupant of said spa and a main control panel at said equipment area, said electrical power source is a high voltage AC source, said main control panel comprises a lower voltage transformer for stepping down said high voltage AC to low voltage AC, a low voltage circuit means including said low voltage transformer, rectifier means for changing said low voltage AC to low voltage DC, said spa side control unit comprises a plurality of low voltage hermetically sealed switches for selectively energizing the circulating pump motor, said blower and said underwater spa light, and exterior, manual control means for manually operating said spa side control panel low voltage switches, said in-house control panel comprises a plurality of manually operated low voltage switches connected in parallel with the low voltage switches of said spa side control panel for operating said electric heater, said electric motor-driven pump means, said electric motor-operated blower, and said spa light independent of said spa side control panel low voltage switches; wherein, within said equipment area, said low voltage circuit means comprises at least one thermostat-operated relay for controlling the flow of high voltage AC current to said heater and a plurality of low voltage relays including relay coils, low voltage contacts and switchable high voltage AC contacts to operatively connect said high voltage AC power source to said heater, said electric motor-driven pump means, said blower and said spa light, respectively; wherein said in-house control panel manually operated switches are connected across respective relay coils of said low voltage DC relays for independently energizing said low voltage relays, said spa further comprises vacation switch means for selectively disabling at least said in-house switch means for operating said low voltage relays and wherein, said main control panel further comprises a series of manual, high voltage override switches in parallel with said spa side and said in-house low voltage switch means for connecting said high voltage AC directly across said electric motor-driven pump means, said blower and said spa light for overriding said low voltage DC switch means.

2. The spa as claimed in claim 1 further comprising a time switch including a timer motor electrically connected across said high voltage AC power source and continuously energized thereby, said time switch including normally open time switch contacts for connecting said electric motor-driven pump means to said high voltage AC power source and operable in response to energization of said timer motor for periodic closing of said normally open time switch contacts such that irrespective of operation of any of said spa side and in-house low voltage switch means, and said high voltage manual override switches of said main control panel, circulation of water through said filter means may be effected.

3. The spa as claimed in claim 2 wherein; said high voltage manual override switches comprise a manual pump ON/OFF switch having a first set of normally closed contacts in series with said normally open time switch contacts, said spa further comprises at least one freeze thermostat connected in series with said electric motor-driven pump means and across said high voltage AC power source and wherein said freeze thermostat comprises normally open contacts, and wherein said manual pump ON/OFF switch includes a second set of normally open contacts connected in a circuit bypassing said at least one freeze thermostat whereby, switching of said manual pump ON/OFF switch from OFF to ON permits energization of said electric motor-driven pump means irrespective of the condition of said at least one freeze thermostat.

4. The spa as claimed in claim 3, wherein said manual override switches of said main control panel further comprise a manual pump low-high switch including a first set of normally closed contacts connecting said manual pump ON/OFF and said manual low-high switches in series, wherein said electric motor-driven pump means comprises a pump motor having separate high speed and low speed windings, wherein said manual pump low-high switch normally closed contacts are connected in a circuit bypassing said at least one freeze thermostat and in series with the low speed windings of the pump motor, and wherein, said manual pump low-high normally open switch contacts are connected in series with said pump motor high speed windings and across said high voltage AC source.

5. The spa as claimed in claim 3, wherein the circuit including said manual pump ON/OFF switch, said at least one freeze thermostat and said pump motor low speed winding across said high voltage AC power source comprises normally closed low voltage relay contacts of said low voltage switch means of said spa side control panel and wherein said spa further comprises a first set of normally closed high voltage contacts for said low voltage relay of said spa side control panel, low voltage switch means connected to said low voltage switch means of said spa side control panel and second high voltage normally closed switch contacts of a low voltage relay connected to a separate low voltage switch of said spa side control panel low voltage switch means, whereby independent of said manual pump ON/OFF switch and manual pump low-high voltage switches at said control panel, said pump motor may be operated at high speed or low speed by selectively closing said first and second low voltage switches of said spa side control panel.

6. The spa as claimed in claim 1, further comprising a main circuit breaker within said main control panel for selectively connecting and disconnecting said high voltage AC power source at said main control panel, said main circuit breaker comprising relay means including normally open switch contacts, a relay coil for closing said normally open main switch contacts upon energization thereof, a magnetic door switch connected across said main circuit breaker relay coil having normally open contacts, and a permanent magnet mounted to the door of said main control panel and responsive to closure of said door and movement into proximity of said magnetic door switch normally open contacts for causing closing of said normally open magnetic door switch contacts and for closing said main circuit breaker contacts upon energization of said main circuit breaker relay coil.

7. The spa as claimed in claim 1, wherein said vacation switch means comprises a normally open first vacation switch in series with a primary winding of said step down transformer and a normally open, manually operated second vacation switch within said in-house control panel in series with all of said in-house manualy operated switches on said in-house control panel and said spa side control panel switch means such that, opening of either said first or said second vacation switches terminates control of said heater, said pump motor, said blower and said spa light through both said spa side control panel and said in-house control panel.

8. The spa as claimed in claim 4, wherein, said manual high voltage override switches within said main control panel include a normally open manual blower switch connected in series with said blower and across said high voltage AC power source and a normally open manual light switch in series with said spa light and across said high voltage AC power source for independently, selectively energizing said spa light and said blower, irrespective of the condition of the low voltage control switches at said spa side control panel and said in-house control panel.

9. The spa as claimed in claim 1 further comprising a latching relay in parallel with said spa light, said latching relay including a relay coil and switch contacts responsive to coil energization for alternatively connecting and disconnecting a light dimmer in series with said spa light to place said spa light directly at two distinctly different levels of illumination.

10. The spa as claimed in claim 1, wherein said spa side control panel comprises a remote bulb thermostat including a thermostat switch having normally open contacts in series with a first relay coil of a first low voltage relay having a set of normally open contacts for effecting, upon closure of those contacts, energization of said heater and wherein said thermostat switch has normally open thermostat switch contacts in series with said relay coil of said first relay connected across said low voltage power source, said remote bulb thermostat includes means for adjusting the temperature effecting closure of said normally open thermostat switch contacts and manual means for adjusting the temperature at which the normally open thermostat switch contacts close and a thermal bulb positioned in proximity to the inlet side of the said piping defining said water circulation loop and being operatively connected to said thermostat switch controls.

11. The spa as claimed in claim 8, wherein said spa side control panel further comprises first and second microswitch arrays of multiple microswitches and manual means for selectively changing the state of individual microswitches of said microswitch arrays, and wherein, said multiple microswitches of said first and second microswitch arrays constitute, for each array at least two microswitches connected in series with second and third, and fourth and fifth low voltage relays respectively, having normally open contacts in series with the high voltage AC power source and across said pump motor means of said blower and said spa light and in parallel with said manual power ON/OFF switch, said manual pump high-low switch, said manual blower switch and said manual light switch at said main control panel.

12. The spa as claimed in claim 1, wherein sap side control panel comprises first, second and third sets of manually operated switches in series with relay coils of respective low voltage relays and connected across said low voltage power source, said low voltage relays include normally open, high voltage and low voltage switch contacts, said high voltage circuit includes a plurality of normally open contacts, thermostats mounted within said circulation loop connected in series with the normally open high voltage contacts, respectively, and across a relay coil of a heater relay having normally open contacts connected in series with said high voltage AC power source such that, in response to selective manual operation of selected ones of said low voltage manually operated normally open switches in series with said high voltage thermostats respectively and dependent upon the temperature of the water circulating within said circulation loop, the normally open contacts of said heater relay close to place said heater coil across said high voltage AC power source.

13. The spa as claimed in claim 1, wherein, said in-house control panel includes manually operated switches connected in parallel with the normally open switches of said switch means of said spa side control unit and across the low voltage power source for selectively energizing the relay coils of said low voltage relays.

14. The spa as claimed in claim 12, wherein said spa side control unit includes first and second LED lights and said heater relay includes a second set of contacts connected in series with a first and second LED light.

15. The spa as claimed in claim 1, wherein, said heater includes an electrical resistance element connected across said high voltage AC power source and in series with normally open contacts of a contactor relay, said contactor relay includes a relay coil connected in series with normally open first set of contacts of said heater relay and wherein, said normally open set of contacts of said heater relay are in turn connected in series with a normally open pressure switch responsive to flow of water to be heated within said water circulation loop, and a normally open ON/OFF switch.

16. The spa as claimed in claim 1, wherein said spa side control unit comprises a rectangular box-like housing having an open face, a cover overlying the open face of said housing and being sealably connected thereto to seal off the interior thereof, at least first and second microswitch arrays fixedly mounted within the interior of said housing, said microswitch arrays each comprising a vertical stack of microswitches having spring biased, retractable operating buttons projecting outwardly of the microswitches, actuator shafts projecting through said cover and mounted for rotation about their axes and in juxtaposition to said microswitches of respective arrays, said shafts having flats thereon forming cam acutating surfaces for controlling the extent of projection of said microswitch buttons, knobs fixedly mounted to the shafts projecting outwardly of said cover and rotatable therewith, and seals carried by one of said knobs and said shafts for sealing off the connection between a shaft and the knob thereon the prevent ingress of water into the sealed interior of the housing for contamination and possible electrical shorting of said microswitches.

17. The spa as claimed in claim 16, wherein, cylindrical hubs are fixedly mounted to the exterior of said cover, said knobs are each of cylindrical form and include a cylindrical recess within the face of the knob proximate to said cover, sized in excess of diameter of said hub, and wherein, each hub includes an annual groove on the periphery thereof, an O-ring is positioned within said groove and bears on the cylindrical wall of the recess within the knob with the O-ring compressed between the knob and the hub and forming said seal for preventing egress of water therebetween.

18. The spa as claimed in claim 16, further comprising spring biased detent pins carried by each said knob and projecting against the outer surface of the cover, said pins having rounded ends selectively received by a series of circumferentially spaced spherical recesses with the outer surface of the cover to mechanically lock the control knob at a given angular position.

19. The spa as claimed in claim 16, wherein said spa side control unit further comprises a thermostat switch fixedly mounted within the interior of said housing, to one side of said at least two microswitch arrays, a rotatable temperature control setting shaft projecting from said thermostat switch and having an end projecting outwardly of said cover, a cylindrical hub fixedly mounted to said cover and having a bore rotatably receiving the projecting end of said temperature control setting shaft of said thermostat switch, a cylindrical control knob fixedly mounted to the projecting end of said temperature control setting shaft and having a cylindrical recess which concentrically surrounds said hub and an O-ring seal mounted to the periphery of said hub, and being compressed between said hub and the recess wall of said control knob for said thermostat switch, such that rotation of said control knob effects a change in the temperature setting of the thermostatic switch associated therewith.

20. The spa as claimed in claim 16, wherein a thin stabilizer plate is positioned on the face of each microswitch array, which is remote from the cover and wherein, mounting screws project through said stabilizer plate and through the microswitches of said array and have threaded ends embedded within said cover to stabilize said microswitch array and wherein, each stabilizer plate includes a hole therein aligned with the actuating shaft of said rotating shaft proximate thereto, and wherein said shaft terminates in a reduced diameter portion at the end thereof remote from said control knob sized to the said hole of said stabilizer plate and projecting within the hole such that the hole within the stabilizer plate acts as a bearing for the reduced diameter portion of said shaft to stabilize the shaft mounting on the cover and to facilitate shaft rotation by operation of the control knob fixedly coupled each shaft.

21. The spa as claimed in claim 17, wherein said spa shell includes a horizontal rim, a rectangular hole is formed within by said rim, said cover is fixedly mounted to said spa shell rim about said hole such that said housing projects downwardly therefrom within said hole, and wherein said spa further comprises an upwardly open rectangular box shape sand shield epoxyed to the bottom of the rim about the periphery of said hole, said sand shield including pipe couplings sealably connected thereto and carrying ends of plastic pipe for carrying electrical lines and the like leading to and from said switch means of said spa side control unit.

22. The spa as claimed in claim 1 further comprising a thermostat well assembly connected within said pipe means forming said water circulating loop, said thermostat well assembly comprising two plastic tees, side-to-side mounted and sealably connected together by a thimble including a flow restriction, a third tee connected to one of said two tees and a 90 degree ell connected by thimbles to said third tee and to said second tee, respectively, defining a bypass flow passage about said flow restriction, a flow reducer within the side of said third tee not connected to said ell, a small diameter plastic pipe sealably mounted to said flow reducer, having one end terminating within said ell and another end projecting outwardly of the thermostat well assembly, and a cap on the end of said small diameter pipe terminating within said ell such that small diameter pipe forms a thermostat well, and wherein, the presence of the flow restriction within the intermediate of the two side-by-side tees diverts the flow without substantial restriction to flow through the circulating loop and wherein, an adequate flow of water in the circulating loop passes about the thermostat well to insure an effective sensing of the mean temperature of the water flow circulating in the loop by a thermostat carried by said well, and connected to the spa side control unit.

* * * * *